US006367101B2

(12) United States Patent
Shimizu

(10) Patent No.: US 6,367,101 B2
(45) **Date of Patent: *Apr. 9, 2002**

(54) AUTOMATIC HAIR WASHER

(75) Inventor: Hirohisa Shimizu, Osaka (JP)

(73) Assignee: Oohiro Works, Ltd, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/476,184

(22) Filed: Jan. 3, 2000

(30) Foreign Application Priority Data

Jul. 26, 1999 (JP) ..... 11-210807

(51) Int. Cl.[7] ..... A45D 19/00

(52) U.S. Cl. ..... 4/523; 4/515; 4/519

(58) Field of Search ..... 4/515, 516, 517, 4/518, 519, 523; 132/212, 272

(56) References Cited

U.S. PATENT DOCUMENTS

| | | | | | |
|---|---|---|---|---|---|
| 493,953 | A | * | 3/1893 | Voss | 4/517 |
| 1,112,262 | A | * | 9/1914 | Cawley | 4/517 X |
| 4,766,620 | A | * | 8/1988 | Boyhan | 4/516 |
| 5,896,595 | A | * | 4/1999 | Spencer | 4/519 |

* cited by examiner

*Primary Examiner*—Robert M. Fetsuga
(74) *Attorney, Agent, or Firm*—Burr & Brown

(57) ABSTRACT

This invention provides an automatic hair washer that is capable of preventing the hairs of the person under hair washing from being attached to the internal wall of the cistern as well as the hairs of the person under hair washing being tangled with each other during the hair washing. By providing a hair receiver having an arch-shaped or ring-shaped hair receiving part, which collects and hangs the hair of the person under hair washing, it is possible to prevent the hair of the person under hair washing from being attached to the internal wall of the sink. Since they are collected by the hair receiver, the tangling of the hair of the person under hair washing by the showers spouted during the hair washing can be prevented.

4 Claims, 3 Drawing Sheets

AUTOMATIC HAIR WASHER

FIELD OF THE INVENTION

The present invention relates to an automatic hair washer and, more particularly, to an automatic hair washer that prevents the hairs of a person undergoing hair washing from becoming tangled with each other.

BACKGROUND OF THE INVENTION

Conventionally, when hairs of a person who has long hairs are washed by an automatic hair washer, the hairs hang into the internal bottom of the cistern, are attached to the internal wall of the cistern, thereby giving unfavorable feelings to the person under hair washing. Therefore, a mesh type hair placing plate which places hairs of the person under hair washing is provided in the sink, whereby it is prevented that hairs of the person under hair washing are attached to the internal wall of the cistern.

FIGS. 4 and 5 are a schematic plan view and a cross-section view at II—II line in FIG. 4, respectively, of a prior art automatic hair washer. In FIG. 4, reference numeral 401 denotes hairs of a person under hair washing, reference numeral 402 denotes a hair placing plate for placing hairs of the person under hair washing 401, and reference numeral 403 denotes a cistern. In FIG. 5, reference characters SH1 to SH6 denote shower heads for spouting hot water and reference characters NH1 to NH3 denote nozzle heads for spouting hot water including hair washing agents.

As shown in FIG. 5, in the prior art automatic hair washer, a mesh type hair placing plate 402 for placing hairs of the person under hair washing is provided in the cistern 403, and the hairs of the person under hair washing are placed on the mesh type hair placing plate 402. Therefore, there is no case where the hairs of the person under hair washing 401 are attached to the internal wall of the cistern 403 thereby to give uncomfortable feelings to the person under hair washing.

However, in the prior art automatic hair washer, since the hairs 401 of the person under hair washing are scattered onto the mesh type hair placing plate 402 in disorder as shown in FIG. 4, the hairs 401 of the person under hair washing are vigorously tangled with each other, urged by showers during the hair washing, which showers are spouted out from a plurality of shower heads which are provided at the internal wall of the cistern 403, thereby resulting in great difficulty in ordering hairs after completing the hair washing.

SUMMARY OF THE INVENTION

It is an object of the present invention to provide an automatic hair washer which can prevent that hairs of the person under hair washing from hanging into the internal bottom of the cistern during the hair washing, and thereby, being attached to the internal wall of the cistern, and causing uncomfortable feelings for the person under hair washing, and further, which can prevent that the hairs of showers spouted out from the plurality of shower heads are confused with each other during the hair washing.

Other objects and advantages of the present invention which will become apparent from the detailed description and specific embodiments described, are provided only for illustration since various additions and modifications within the spirit and scope of the invention will be apparent to those of skill in the art from the detailed description.

According to a first aspect of the present invention, an automatic hair washer comprises: a cistern for containing a head part of a person under hair washing; a hair washing means for washing hairs of a person under hair washing by spouting hot water into the cistern; and a hair receiving member for hanging hairs of the person under hair washing collectively.

According to a second aspect of the present invention, in an automatic hair washer of claim 1, the hair receiving member includes a hair receiving part comprising an arch-shaped linear member.

According to a third aspect of the present invention, in an automatic hair washer of claim 1, the hair receiving member includes a hair receiving part comprising a ring-shaped linear member.

According to a fourth aspect of the present invention, an automatic hair washer of any of claims 1 to 3, wherein: an attaching member for attaching said hair receiving member is provided at an upper part of said cistern and said hair receiving member is provided detachably from said attaching member.

DETAILED DESCRIPTION OF THE PREFERRED EMBODIMENTS

Embodiment 1.

Figure 1:
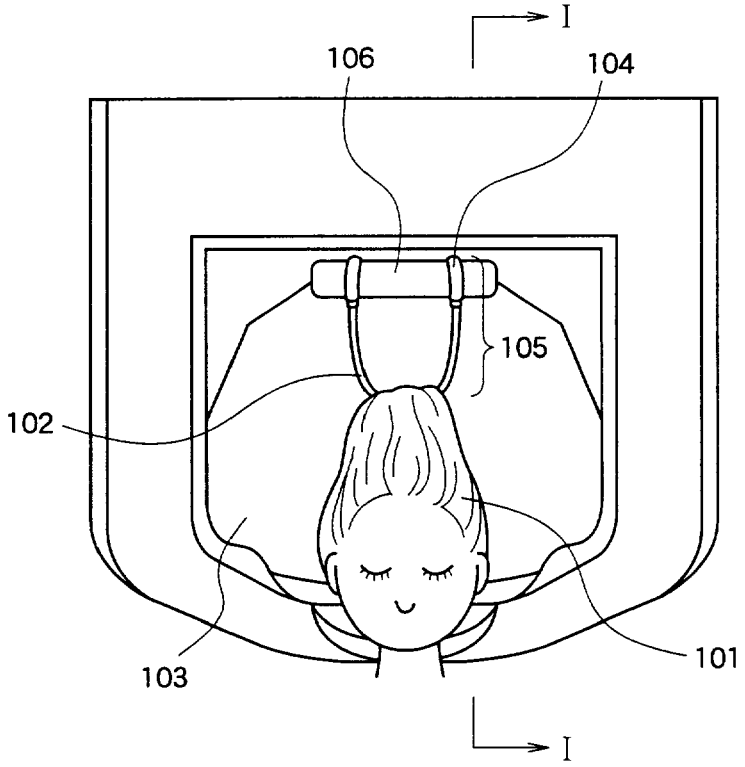
FIG. 1 is a plan view schematically illustrating an automatic hair washer according to the first embodiment of the present invention.
Figure 2:
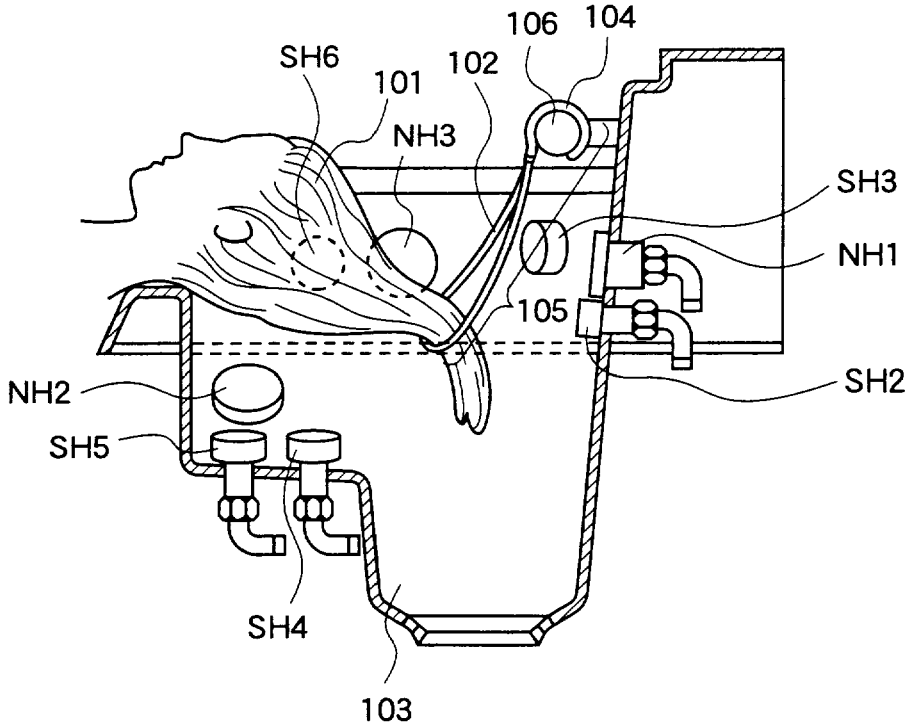
FIG. 2 is a cross-section in line I—I in FIG. 1 illustrating the automatic hair washer according to the second embodiment of the present invention.

A description is given of a first embodiment of the present invention with reference to FIGS. 1 and 2.

FIG. 1 is a plan view schematically illustrating an automatic hair washer according to a first embodiment of the present invention. FIG. 2 is a cross-section view of line I—I in FIG. 1 illustrating the automatic hair washer according to the first embodiment of the present invention.

In FIG. 1, reference numeral 101 denotes hairs of a person under hair washing. Reference numeral 102 denotes a hair receiving part comprising an arch-shaped linear member for receiving the hairs 101 of the person under hair washing. Reference numeral 103 denotes a cistern. In addition, reference numeral 104 designates a hook attached to the hair receiving part 102. The hair receiver 105 for hanging the hairs 101 of the person under hair washing comprises the hair receiving part 102 and the hook 104. Reference numeral 106 designates an attaching part for attaching the hook 104. In addition, in FIG. 2, reference characters SH1 to SH6 denote shower heads for spouting hot water, and reference characters NH1 to NH3 denote nozzle heads for spouting out hot water including hair washing agents.

In FIG. 2, the elements which have the same reference numerals or characters assigned correspond to the elements shown in FIG. 1 having the same reference numerals or characters assigned.

In this specification, "arch-shaped" includes "arch-shaped of real circle" as well as "arch-shaped of ellipse", "arch-shaped of parabola", and "arch-shaped of catenary". In addition, in this specification, "linear shaped" means "stripe shaped", and includes "a stripe shaped one" of soft material such as rubber, soft metal, or textile, as well as "a stripe shaped one" of hard material such as plastic, or hard metal.

As shown in FIG. 2, the hairs 101 of the person under hair washing are collected by the hair receiving part 102, and the hook 104 of the hair receiver 105 is attached to the attaching member 106 so that the hairs are hung.

By providing a hair receiver 105 which collects and hang the hairs of the person under hair washing, it is possible to prevent the hairs of the person under hair washing from being attached to the internal wall of the cistern 103. In addition, the hairs 101 of the person under hair washing should not be scattered even when the power of the showers for washing hairs become strong. Since they are collected by the hair receiving part 102, the tangle of the hairs 101 of the person under hair washing by the showers spouted during the hair washing can be prevented, and the ordering of hairs after the hair washing can be eased.

Further, since the hair receiver 105 is attached to the attaching member 106 by the hook 104, the hair receiver 105 can be removed from the attaching member 106. Therefore, it is possible to, by employing the hair receiver 105 of a length in accordance with the length of the hairs 101 of the person under hair washing, freely move the hairs 101 of the person under hair washing to a position appropriate for the hair washing.

Embodiment 2.

Figure 3:
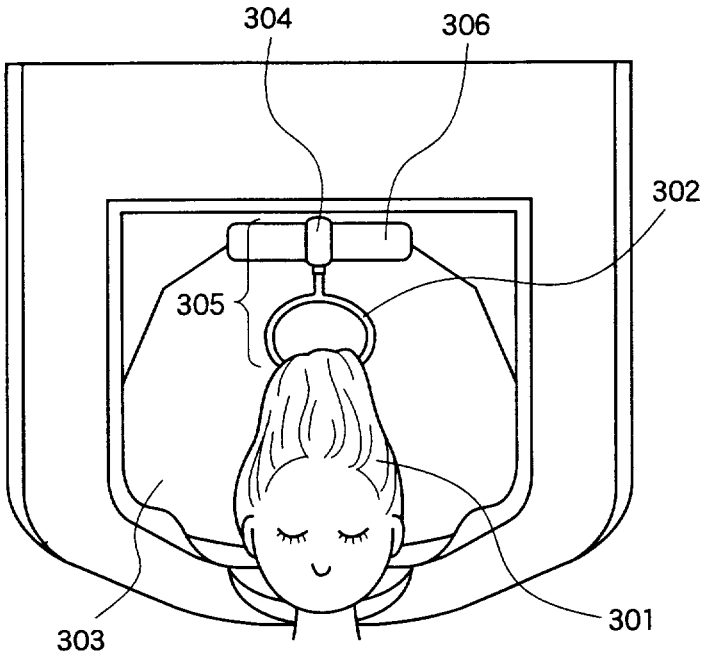
FIG. 3 is a plan view schematically illustrating an automatic hair washer according to the second embodiment of the present invention.
Figure 4:
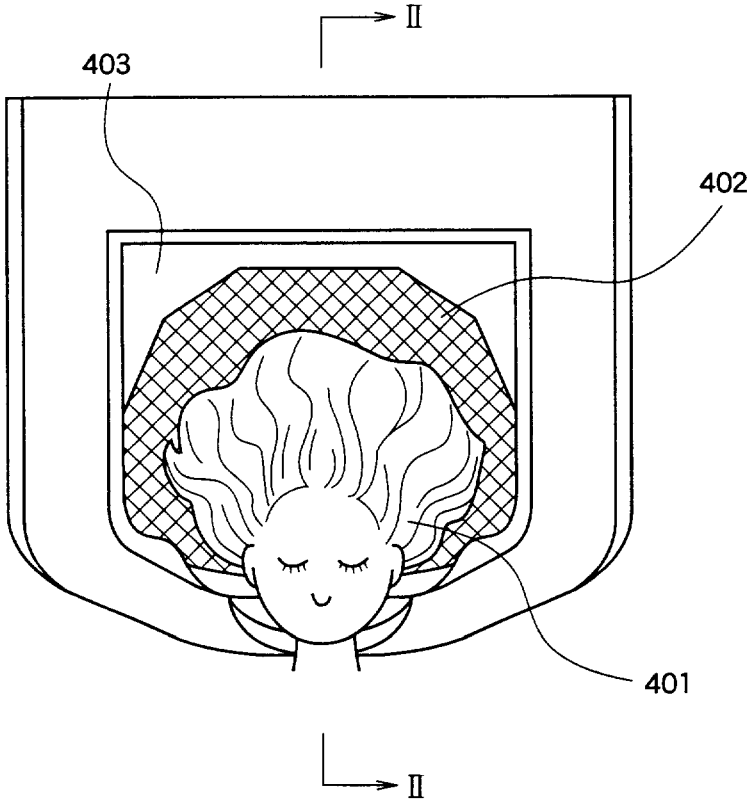
Fig.4 Prior Art
FIG. 4 is a plan view illustrating a prior art hair washer.
Figure 5:
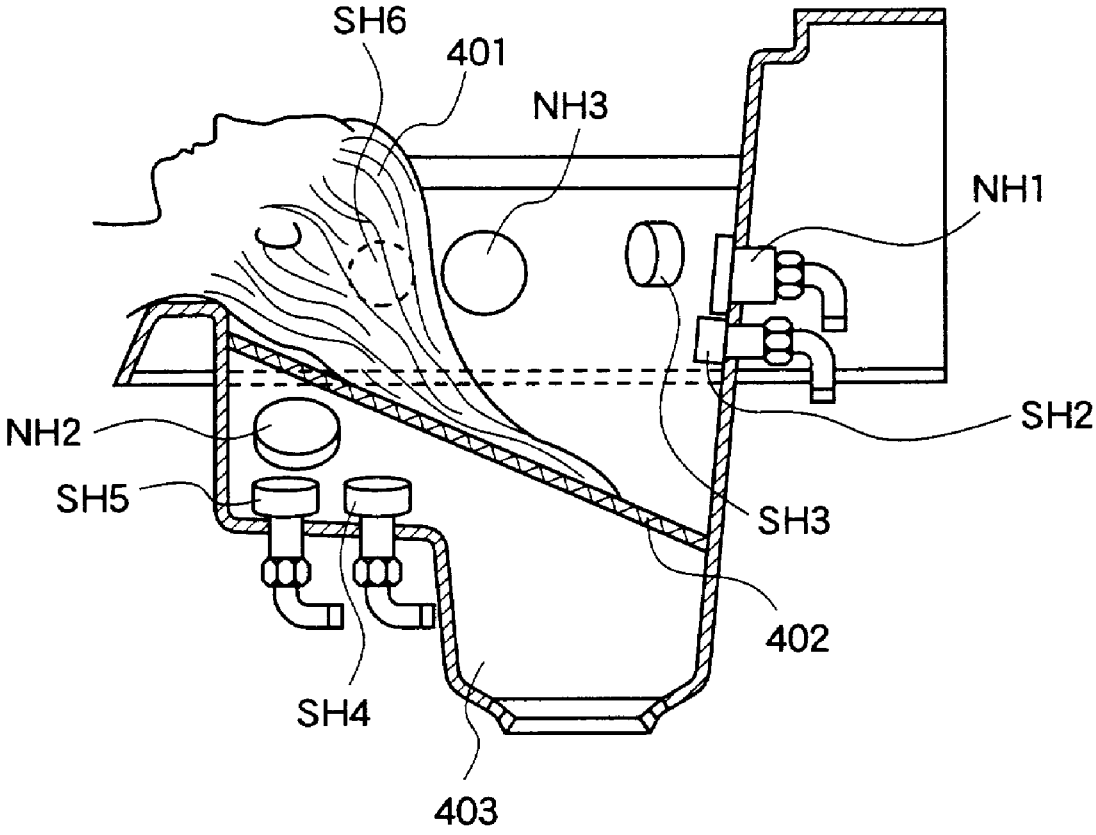
Fig.5 Prior Art
FIG. 5 is a cross-section in line II—II in FIG. 3 illustrating the prior art hair washer.

A description is given of an automatic hair washer according to a second embodiment of the present invention with reference to FIG. 3.

FIG. 3 is a plan view schematically illustrating an automatic hair washer according to a second embodiment of the present invention. Reference numeral 301 denotes hairs of a person under hair washing. Reference numeral 302 denotes a hair receiving part comprising a ring-shaped linear member for receiving the hairs 301 of the person under hair washing. Reference numeral 303 denotes a cistern. Numeral 304 denotes a hook attached to the hair receiving part 302. A hair receiver 305 which collectively hang the hairs 301 of the person under hair washing is comprised of the hair receiving part 302 and the hook 304. Reference numeral 306 denotes an attaching member for attaching the hook 304.

In the specification, "ring-shaped", of course, includes "circular shaped", but it is not limited thereto. "Loop-shaped" one that can make the hairs of the person under hair washing be collected and pass therethrough can be employed.

As shown in FIG. 3, the hairs 301 of the person under hair washing are gathered by the hairs 301 of the person under hair washing being collected and made to pass through the ring-shaped hair receiving part 302, and are hung over by that the hook 304 of the hair receiver 305 is attached to the attaching member 306.

By providing the hair receiver having the hair receiving part 302 for collecting and hanging the hairs 301 of the person under hair washing, it is possible to prevent the hairs 301 of the person under hair washing from becoming attached to the internal wall of the cistern 303 as in the first embodiment of the prevent invention. In addition, the hairs 301 of the person under hair washing are collected by the hair receiving part 302 without being scattered even when the power of the hair washing shower is strengthened, whereby tangling of the hairs 301 of the person under hair washing by the shower spouted out at the hair washing is prevented and the ordering of the hair after hair washing is eased.

In addition, the hair receiver 305 is attached to the attaching part 306 by the hook 304, and the hair receiver 305 can be removed from the attaching part 306. Therefore, as in the first embodiment, by employing the hair receiver 305 having a length corresponding to the length of the hairs 301 of the person under hair washing, it is possible to move the hairs 301 of the person under hair washing to a position appropriate for the hair washing.

While in the first and the second embodiments, a description is given of a case where the hair receiving part is attached to an attaching part by a hook, the same effect as described above also can be obtained when the same is detached by other detachable means.

While in the first and the second embodiments, a description is given of a case where hair receivers of different lengths corresponding to the length of the hairs of the person under hair washing are employed, the length may be adjusted by a means for adjusting the length such as a band.

While in the first embodiment the hair receiving part comprises an arch-shaped linear member and in the second embodiment the hair receiving part comprises a ring-shaped linear member, the hair receiving part is not limited thereto, and that which collects and hang the hairs of the person under hair washing may be employed with the same effects.

What is claimed is:

1. An automatic hair washer comprising:

a cistern for containing a head part of a person under hair washing;

a hair washing means for washing hairs of a person under hair washing by spouting hot water into the cistern from plural nozzles fixed at an inside wall of the cistern; and a hair receiver for collectively hanging hairs of the person under hair washing, wherein the hair receiver includes a hair receiving part consisting of an arch-shaped member.

2. An automatic hair washer as in claim 1, wherein an attaching member for said hair receiver is provided at an upper part of the cistern and the hair receiver is provided detachably from the attaching member.

3. An automatic hair washing comprising:

a cistern for containing a head part of a person under hair washing;

a hair washing means for washing hairs of a person under hair washing by spouting hot water into the cistern from plural nozzles fixed at an inside wall of the cistern; and a hair receiver for collectively hanging hairs of the person under hair washing, wherein the hair receiver includes a hair receiving part consisting of a ring-shaped member.

4. An automatic hair washer as in claim 3, wherein an attaching member for said hair receiver is provided at an upper part of the cistern and the hair receiver is provided detachably from the attaching member.

* * * * *